United States Patent [19]

Wellslager et al.

[11] 4,260,007

[45] Apr. 7, 1981

[54] METHOD AND APPARATUS FOR CASTING AMORPHOUS FILAMENT USING A CRUCIBLE WITH A BORIC OXIDE SEAL

[75] Inventors: John A. Wellslager, Mt. Arlington; Susan L. Rosenberg, Landing, both of N.J.

[73] Assignee: Allied Chemical Corporation, Morris Township, Morris County, N.J.

[21] Appl. No.: 20,304

[22] Filed: Mar. 14, 1979

[51] Int. Cl.[3] ..... B22D 11/10; B22D 39/00; B22D 41/08

[52] U.S. Cl. ..... 164/64; 164/82; 164/423; 164/437; 222/594

[58] Field of Search ..... 164/82, 133, 437, 335, 164/337, 423, 64; 222/593, 597, 54; 65/2, 324, 326, 327, 374 R

[56] References Cited

U.S. PATENT DOCUMENTS

| | | | |
|---|---|---|---|
| 3,268,958 | 8/1966 | Sickbert | 164/133 X |
| 3,856,513 | 12/1974 | Chen et al. | 75/122 |
| 3,896,870 | 7/1975 | Massoubre | 164/423 |
| 3,926,248 | 12/1975 | English | 164/82 X |
| 3,964,535 | 6/1976 | Bedell et al. | 164/82 X |
| 4,029,887 | 6/1977 | Spremulli | 65/326 X |
| 4,142,571 | 3/1979 | Narasimhan | 164/88 |

OTHER PUBLICATIONS

Gilman, John J. "Metallic Glasses," *Physics Today*, vol. 28 No. 5, May, 1975.

*Primary Examiner*—Robert Louis Spruill
*Assistant Examiner*—Gus T. Hampilos
*Attorney, Agent, or Firm*—James Riesenfeld; Gerhard H. Fuchs

[57] ABSTRACT

An improvement is provided in a method for the continuous casting of glassy metal alloy filaments wherein molten alloy is extruded from a pressurized crucible through an extrusion orifice onto a rotating quench surface. The invention provides a boric oxide seal for the extrusion orifice that prevents oxidation of the molten alloy prior to initiation of extrusion. At initiation of extrusion, the seal is conveniently expelled from the orifice with the leading surge of the extruded molten alloy.

10 Claims, 2 Drawing Figures

METHOD AND APPARATUS FOR CASTING AMORPHOUS FILAMENT USING A CRUCIBLE WITH A BORIC OXIDE SEAL

BACKGROUND OF THE INVENTION

The present invention relates generally to the sealing of a small orifice in the presence of a high temperature, molten material and specifically to the use of boric oxide to temporarily seal an extrusion orifice in connection with the continuous casting of glassy metal alloy filaments.

Glassy metal alloys are of considerable technological interest owing to their extraordinary physical properties as compared to the properties characterizing the polycrystalline form of such alloys. An overview of the nature of such materials and their properties are given in "Metallic Glasses", 28:5 Physics Today (1975) by J. J. Gilman. The term "glassy metal alloy" is intended to refer to metals and alloys that are rapidly quenched from a liquid state to a substantially amorphous (noncrystalline) solid state, typically having less than about 50% crystallinity, and is considered to be synonymous with such terms as "amorphous metal alloy" and "metallic glass". Glassy metal alloys are well documented in the literature. For an extensive background see "Metallic Glasses", American Society for Metals (1978).

Glassy metal alloys are typically produced in filamentary form by extruding an appropriate molten alloy from a pressurized reservoir through an extrusion nozzle onto a high speed rotating quench surface, providing extreme quench rates typically exceeding $10^5$° C. per second, as is representatively shown in allowed U.S. Pat. Application No. 821,110 filed Aug. 2, 1977, now U.S. Pat. No. 4,142,571, for "Continuous Casting Method for Metallic Strips" by M. Narasimhan, hereby incorporated by reference. The term "filament" is intended to include ribbon-like strips, as well as wire-like filaments, of regular or irregular cross-section.

The present invention addresses the problem of the extrusion orifice becoming plugged in such operations, arising from reaction of the molten charge within the crucible with the ambient atmosphere during start up of the casting process. Typically the crucible is charged with the alloy to be extruded which is heated to the molten condition while concurrently producing a vacuum in the crucible sufficient to prevent the molten charge from flowing from the crucible through the extrusion orifice. When ready to cast, the crucible pressure is increased sufficiently to extrude the molten charge from the crucible through the extrusion orifice onto the rotating quench surface. During the holding period just prior to extrusion, the highly reactive molten metal has sufficient exposure to the atmosphere via the extrusion orifice such that certain alloying agents and trace-impurities are oxidized to form particulate matter in the molten charge as insoluble oxide particles. These oxide particles tend to accumulate in the extrusion orifice as casting proceeds or are taken into the cast filament as oxide inclusions, thus disturbing the uniformity of the cast filament.

This problem has been dealt with generally by providing an inert gas flow about the orifice. However, for configurations requiring that the outlet of the extrusion orifice be in close proximity to the rotating quench surface, the gas-cover apparatus must be removed from the vicinity of the nozzle as the crucible is brought onto the quench surface, thereby exposing the molten charge to oxidation for a brief but sufficient period to form particulate matter in the melt. A further step then has been to increase the temperature of the melt to solubilize these oxide particles. However, this procedure is highly undesirable since the melt must then be quenched over a greater temperature range. Practically, the extreme quench rates required in quenching the melt below its crystallization temperature to form an amorphous alloy are difficult to achieve.

An alternative approach to this problem is shown in U.S. Pat. No. 3,964,535 "Stopper Rod Tapping Assembly and Filament Forming Process" issued June 22, 1976, to J. Bedell and R. Smith, wherein a vented tapping rod effects closure and clearing of the extrusion orifice. While this approach is generally satisfactory, it requires the use of rather complex apparatus.

The present invention overcomes these limitations by providing an effective temporary seal for the extrusion orifice that is conveniently expelled from the orifice as extrusion is initiated with the leading surge of extruded molten alloy.

SUMMARY OF THE INVENTION

The method of the invention provides for an improvement in a process for the casting of metal filaments, wherein molten metal is extruded from a crucible through an extrusion orifice onto a moving quench surface, comprising the steps:

(a) utilizing an orifice that is composed of a material wettable by molten boric oxide; and (b) sealing the orifice with boric oxide to prevent reaction of a molten charge held in the crucible with the ambient atmosphere.

The method may include the additional steps:

(c) charging the crucible with the metal to be extruded, the metal being substantially nonreactive with molten boric oxide;

(d) producing a vacuum in the crucible sufficient to prevent the metal from flowing through the orifice when the metal is molten;

(e) heating the metal to the molten state and to a temperature at least higher than the softening point of boric oxide such that the boric oxide is molten; and (f) increasing the pressure in the crucible sufficiently to extrude the molten metal through the orifice onto the moving quench surface whereby the molten boric oxide is expelled with the leading surge of extruded flow.

Preferably, the extrusion orifice is sealed by solidifying molten boric oxide in the orifice. The boric oxide is preferably obtained by dehydrating boric acid.

The apparatus of the invention provides for an improvement in an apparatus for the casting of metal filaments, including a crucible having an extrusion orifice for extruding molten metal from the crucible onto a moving quench surface, wherein the orifice is provided with a boric oxide seal and is composed of a material wettable by molten boric oxide. The orifice is preferably composed of fused silica.

BRIEF DESCRIPTION OF THE DRAWINGS

Further details are given below with reference to the embodiments shown in the drawings wherein.

DESCRIPTION OF THE PREFERRED EMBODIMENTS

Figure 1:
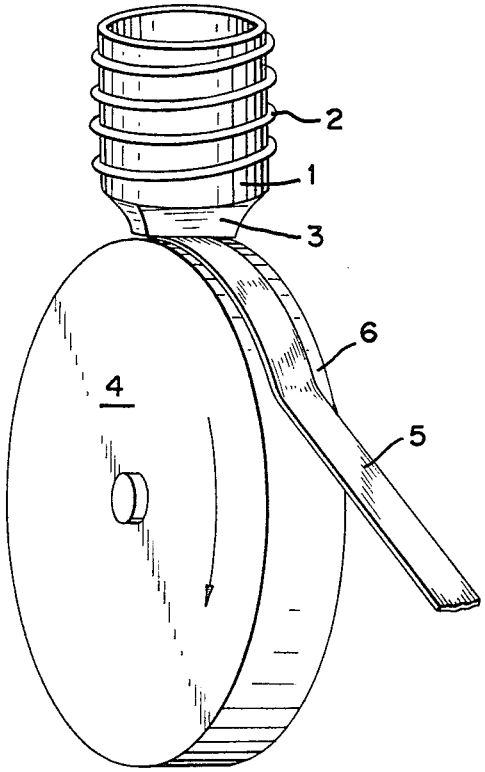
FIG. 1 (PRIOR ART)
FIG. 1 is an illustration of typical prior art apparatus for the continuous casting of glassy metal alloy continuous filaments, in which a molten stream is extruded from a pressurized crucible through an extrusion orifice or nozzle onto a rotating quench wheel.

Referring specifically to the drawings, in FIG. 1, typical prior art apparatus for the continuous casting of a glassy metal alloy filament is illustrated to point out the general use of the present invention. The molten alloy is contained in a crucible 1 provided with a heating element 2. Pressurization of the crucible 1 with an inert gas causes a molten stream to be extruded through an orifice in a nozzle 3 at the base of the crucible 1 onto a rotating quench wheel 4. The solidified, moving filament 5, after its break away point from the quench surface 6, is typically routed through a tension regulator and finally onto a winder (not shown).

The problem addressed by the present invention arises during start-up of the process. Typically, the start-up procedure entails the steps of charging the crucible with the room temperature alloy to be extruded; heating the charge to the molten condition and applying a vacuum over the charge before melting to prevent the molten charge from flowing through the extrusion orifice prematurely; and finally, increasing the gas pressure within the crucible sufficiently to extrude the melt through the orifice at a selected rate, thereby initiating casting of the filament. To prevent oxidation of the highly reactive molten alloy just prior to initiation of extrusion, an inert gas cover is provided about the extrusion orifice, typically by covering the orifice area with a cap through which an inert gas flow is passed. However, this protective apparatus must be removed prior to bringing the crucible and orifice into position over the quench surface, especially in those configurations wherein the orifice is in close proximity to the quench surface. In this brief period, sufficient oxidation occurs within the melt such that insoluble oxide particles of alloying agents or trace impurities, such as silicon and aluminum, are formed which are either carried into the quenched filament as oxide inclusions or accumulate at the orifice tending to plug the orifice as extrusion proceeds. Increasing the melt temperature in attempting to dissolve such particulate matter is unsatisfactory in that the already stringent heat transfer requirements in quenching the extruded flow, typically exceeding $10^{5}$° C. per second, are aggravated.

Figure 2:
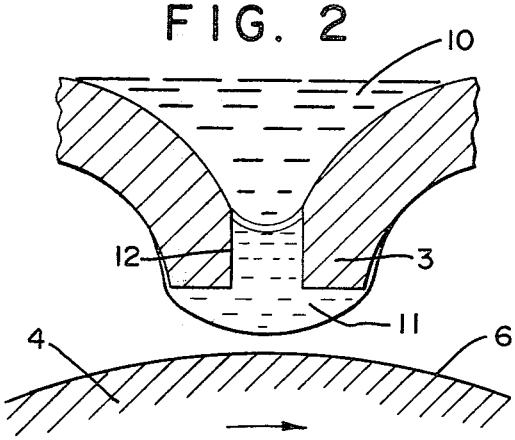
FIG. 2 is a cross-sectional view of the extrusion orifice in close proximity to the rotating quench surface illustrating the present invention just prior to initiation of extrusion, wherein the molten metal to be extruded is prevented from flowing through the extrusion nozzle by a partial vacuum applied over the melt and molten boric oxide clings to the orifice surfaces by surface tension, thereby preventing reaction of the melt with the ambient atmosphere.

In FIG. 2, the extrusion orifice seal 11 of the present invention is illustrated wherein a cross-sectional view of the extrusion orifice 12 is in close proximity to the moving quench surface 6. The molten charge 10 is held in the crucible 1 by a vacuum drawn over the melt 10 in the crucible 1. Boric oxide 11, molten as a result of the crucible temperature exceeding the softening point of boric oxide (depending on thermal history), clings within and about the the orifice 12 in wetting the orifice surfaces thereby preventing atmospheric contact with the melt 10. To begin extrusion, the crucible pressure is increased to the appropriate extrusion pressure thereby conveniently expelling the molten boric oxide orifice seal 11 with the leading surge of extruded flow.

The boric oxide orifice seal may be prepared simply by flowing molten boric oxide in and about the orifice of the crucible and allowing solidification prior to use. Thus, a number of crucibles with integral extrusion orifices may be prepared accordingly and stored until their use is required in the casting operation. Further, it is preferred to obtain the boric oxide by dehydrating boric acid and towards the end of the dehydration process to pull the molten material into rod-like segments, similar to welding-rods, to facilitate forming the boric oxide seal in the extrusion orifice.

It is well known that upon continued heating of boric acid above 100° C., the substance gradually loses water by stagewise dehydration until the anhydrous oxide, $B_2O_3$, is obtained, dehydration being substantially complete at about 450° C. It is preferred to substantially complete the dehydration process; otherwise, any further dehydration during operation with the associated vapor emission (bubbles) would likely disrupt the orifice seal. Boric oxide is normally obtained in the vitreous (glassy) state, which softens at about 325° C. and becomes just pourable at about 500° C. As for the crystalline forms of boric oxide, crystallization is not readily attained without utilizing elaborate procedures involving seed crystals or high pressure. Therefore, the crystalline forms are of far less practical importance, than the vitreous form. In any event, it is primarily the properties of the molten boric oxide that are of importance in the present invention.

To obtain boric oxide rods as described above, a convenient procedure is to place a quantity of boric acid in a crucible and to apply heat by a propane torch to dehydrate the boric acid. At the beginning of dehydration, the boric acid will soften and vapor bubbles will be emitted. Upon continued heating and upon the termination of vapor emission (bubbles), the material will be in a softened condition and may be pulled into rod-like segments, similar to drawing glass. These rods may then be stored until eventual use in forming the orifice seal. Later, the orifice seal may be formed conveniently by using a torch and the boric oxide "welding rods" to "weld" the seal into place.

These are several aspects of the invention. First, the extrusion orifice must be wettable by molten boric oxide so that surface tension of the molten boric oxide holds it in place maintaining the orifice seal until extrusion begins. Typically, in the production of glassy metal alloy filaments, a fused silica crucible with an integral extrusion orifice in its base is utilized. Fused silica is readily wettable by molten boric oxide.

As a corollary to this first requirement, the temperature of the orifice, just prior to initiation of casting, must at least equal the softening point of boric oxide so that the seal, by becoming molten, may be easily expelled with the leading surge of extruded alloy. As most alloys have melting points greatly exceeding the softening point of boric oxide, sufficient heat is transferred from the melt and crucible to melt the boric oxide orifice seal.

Preferably, the geometry of the orifice opening is of dimensions such that the surface tension of molten boric oxide is sufficient to support the boric oxide seal in place as against its weight. If this is not the case, surface tension at the interface in the orifice between the molten alloy and the molten boric oxide provides the major support for the protective layer of boric oxide. Practically speaking, orifice geometry is not a problem in this respect, since the extrusion orifice will generally have an opening corresponding in shape to that of the filament being produced, for example a slotted orifice for a filament of rectangular cross-section. Further, the dimensions of the orifice opening will be about the same order of magnitude as the cross-sectional dimensions of the filament; and since at least one transverse dimension of the filament must be small, typically less than about 100 microns, owing to the extreme heat transfer requirements to quench an alloy to a substantially amorphous condition, surface tension of the molten boron oxide seal will be sufficient to support the seal across the orifice opening. Typically, such slotted orifices have dimensions in the range of about 0.01 to 0.04 inch width (about 0.25 to 1.0 mm) by about 0.5 to 1.0 inch (about 1.3 to 2.5 cm) to produce a strip having transverse dimensions in the range of about 1 to 4 mils thickness (about 25 to 100 microns) by about 0.5 to 1.0 inch (about 1.3 to 2.5 cm), respectively. Width is measured in the direction of movement of the quench surface.

The molten alloy to be extruded should be substantially nonreactive with molten boric oxide. If a substantial reaction were to occur, then the integrity of the orifice seal would be impaired. Molten boric oxide is well known to be highly stable in the presence of a wide range of molten alloys, as shown by its extensive use as a welding flux.

By way of example, a group of alloys especially suited for glassy metal alloy filament casting in conjunction with the present invention are of the formula $M_aY_bZ_c$ where M is a metal selected from the group consisting essentially of iron, nickel, chromium, cobalt, vanadium, and mixtures thereof, Y is a metalloid selected from the group consisting essentially of phosphorus, carbon, boron, and mixtures thereof, and Z is an element selected from the group consisting essentially of aluminum, silicon, tin, antimony, germanium, indium, beryllium, and mixtures thereof, where a, b and c are atomic percentages ranging from about 60 to 90, 10 to 30, and 0.1 to 15 respectively, further provided that $a+b+c=100$. Another group of alloys similarly suited are of the formula $T_aX_b$ where T is a transition metal or a mixture of transition metals and X is an element selected from the group consisting essentially of aluminum, antimony, beryllium, boron, germanium, carbon, indium, phosphorus, silicon, tin, and mixtures thereof, where a and b are atomic percentages ranging from about 70 to 87 and 13 to 30 respectively, further provided that $a+b=100$. These glassy metal alloys are discussed in detail in U.S. Pat. No. 3,856,513 "Novel Amorphous Metals and Amorphous Metal Articles" issued Dec. 24, 1974, to H. Chen and D. Polk, hereby incorporated by reference.

Although the present invention has been described in conjunction with preferred embodiments, it is to be understood that modifications and variations may be utilized without departing from the principles and scope of the invention as those skilled in the art will readily understand. Accordingly, such modifications and variations may be practiced within the scope of the following claims:

What is claimed is:

1. In a method for the casting of metal filaments, wherein molten metal is extruded from a crucible through an extrusion orifice onto a moving quench surface, the improvement comprising:

(a) providing a crucible utilizing an orifice that is composed of a material wettable by molten boric oxide;

(b) sealing said orifice with boric oxide to prevent reaction of a molten charge held in said crucible with the ambient atmosphere;

(c) charging the crucible with the metal to be extruded, said metal being substantially nonreactive with molten boric oxide;

(d) producing a vacuum in the crucible sufficient to prevent the metal from flowing through the orifice when the metal is molten;

(e) heating the metal to the molten state and to a temperature at least higher than the softening point of boric oxide such that the boric oxide is molten; and (f) increasing the pressure in the crucible sufficiently to extrude the molten metal through the orifice onto the moving quench surface whereby the molten boric oxide is expelled with the leading surge of extruded flow.

2. The method, as in claim 1, wherein said orifice is sealed with boric oxide by solidifying molten boric oxide in said orifice.

3. The method, as in claim 2, wherein said boric oxide is obtained by dehydrating boric acid.

4. The method, as in claim 1, wherein the outlet of said orifice is substantially rectangular in cross-section and has a width in the range of about 0.01 to 0.04 inch (0.25 to 1.0 mm) measured in the direction of movement of said quench surface.

5. The method, as in claim 1, wherein said orifice is composed of fused silica.

6. The method, as in claim 1, wherein said metal is of the formula $M_aY_bZ_c$ and M is a metal selected from the group consisting essentially of iron, nickel, chromium, cobalt, vanadium, and mixtures thereof, Y is a metalloid selected from the group consisting essentially of phosphorus, carbon, boron, and mixtures thereof, and Z is an element selected from the group consisting essentially of aluminum, silicon, tin, antimony, germanium, indium, beryllium, and mixtures thereof, where a, b and c are atomic percentages ranging from about 60 to 90, 10 to 30, and 0.1 to 15, respectively, further provided that a plus b plus c equals 100.

7. The method, as in claim 1, wherein said metal is of the formula $T_aX_b$ and T is a transition metal or a mixture of transition metals and X is an element selected from the group consisting essentially of aluminum, antimony, beryllium, boron, germanium, carbon, indium, phosphorus, silicon, tin, and mixtures thereof, where a and b are atomic percentages ranging from about 70 to 87 and 13 to 30, respectively, further provided that a plus b equals 100.

8. In an apparatus for the casting of metal filaments, including a crucible having an extrusion orifice for extruding molten metal from the crucible onto a moving quench surface, the improvement comprising:

said orifice being provided with a boric oxide orifice seal and being composed of a material wettable by molten boric oxide.

9. Apparatus, as in claim 8, wherein the outlet of said orifice is substantially rectangular in cross-section and has a width in the range of about 0.01 to 0.04 inch (0.25 to 1.0 mm) measured in the direction of movement of said quench surface.

10. Apparatus, as in claim 8, wherein said orifice is composed of fused silica.

* * * * *